United States Patent [19]

Brasko et al.

[11] 3,962,060

[45] June 8, 1976

[54] CONTINUOUS ELECTRODEPOSITION OF COATING MATERIAL ON METAL SHEET STOCK

[75] Inventors: Peter Brasko; Daniel E. Festa, both of New Kensington, Pa.; Kenneth E. Buse, Davenport, Iowa

[73] Assignee: Aluminum Company of America, Pittsburgh, Pa.

[22] Filed: Oct. 23, 1974

[21] Appl. No.: 517,327

[52] U.S. Cl. ..... 204/181; 204/300 EC

[51] Int. Cl.[2] ..... C25D 13/06; C25D 13/16

[58] Field of Search ..... 204/181, 300 EC

[56] References Cited

UNITED STATES PATENTS 3,492,213 1/1970 Johnson ..... 204/181

3,540,990 11/1970 Onishi et al. ..... 204/181

*Primary Examiner*—Howard S. Williams

*Attorney, Agent, or Firm*—John P. Taylor

[57] ABSTRACT

An electrophoretic coating system for continuous application to coiled metal sheet stock is provided which permits high speed coating of both sides of sheet stock by passing the sheet through a coating station without contacting the sheet with rollers or changing the direction with rollers. The sheet stock is coated and supported simultaneously by jets of liquid coating material which pass through perforated electrodes.

10 Claims, 3 Drawing Figures

CONTINUOUS ELECTRODEPOSITION OF COATING MATERIAL ON METAL SHEET STOCK

BACKGROUND OF THE INVENTION

This invention relates to the coating of metal sheet. More particularly, this invention relates to a system for high speed electrophoretic coating of metal sheet stock.

Metal sheet stock such as, for example, aluminum, is conventionally coil coated prior to subsequent fabrication of the metal into desired objects such as containers, siding, or the like, by uncoiling the metal and passing it through cleaning and conversion coating operations prior to application of an organic coating material thereon. While the cleaning and conversion coating may be done at relatively high speeds (1200–1600 feet per minute) conventional organic coatings are then applied at much lower speeds (500–600 feet per minute) because of heat buildup, wear of the rolls, slinging of material from the rolls, as well as curing or drying requirements with such conventional organic materials.

It is known to electrophoretically coat metal on a continuous basis. For example, Rimbach U.S. Pat. No. 2,576,362 illustrates a process wherein a wire is passed through a coating station located above a bath whereby the wire as it is unwound is passed through the station and subsequently through a heating station without any redirecting of the wire around other rollers which would change the direction of the wire to either slow the speed down or interfere in any way with the coating thereon.

It is also known to electrodeposit coating material on coiled metal stock. For example, Clark U.S. Pat. No. 2,214,876 discloses electrocoating of aluminum, tantalum, magnesium, or the like by electrodeposition of an organic coating material onto the metal. Metcalfe et al. U.S. Pat. No. 2,898,279 also shows the electrodeposition of coating materials on sheet which may be metallic. However, in both instances the substrate to be coated is directed into a coating bath via rollers or the like which can slow down the coating line or interfere with the application of the coating to the substrate.

While, as referred to above, it is not unknown to coat a material outside of the bath, such processes are usually limiting in that either the coating station is of short length with a slow passage therethrough (to provide adequate residence time) or a longer coating line s used—to again provide adequate residence time—but necessitating the use of supporting rollers which, in turn, interfere with the coating of the substrate.

SUMMARY OF THE INVENTION

It is therefore an object of this invention to provide a system for electrodeposition of coating material on a metallic coil where a metal coil may be continuously coated by electrodeposition of material thereon without passing the coil through a bath and without the necessity of providing supporting rollers therefor, either of which could tend to slow down or interfere with the coating operation.

In accordance with the invention, coating material is electrodeposited on metal sheet stock in a system wherein the sheet is uncoiled and cleaned and then passed in a substantially straight line through coating, drying and baking stations. The sheet is supported in the coating station by passing the sheet through streams which impinge liquid coating material respectively on the opposite surfaces of the sheet. The volume or velocity of the streams are adjustable to provide a floating type support of the sheet between the streams. The liquid streams are in electrical contact with electrodes which set up fields between the electrodes and the metal sheet which comprises the other electrodes, thereby causing the coating material to electrodeposit on the surface of the metal sheet. In one embodiment of the invention, the adjustable streams may be adjusted to position the sheet closer to one electrode than the other to vary the thickness of the coating on one side of the sheet with respect to the thickness on the other side of the sheet.

DESCRIPTION OF THE INVENTION

Figure 1:
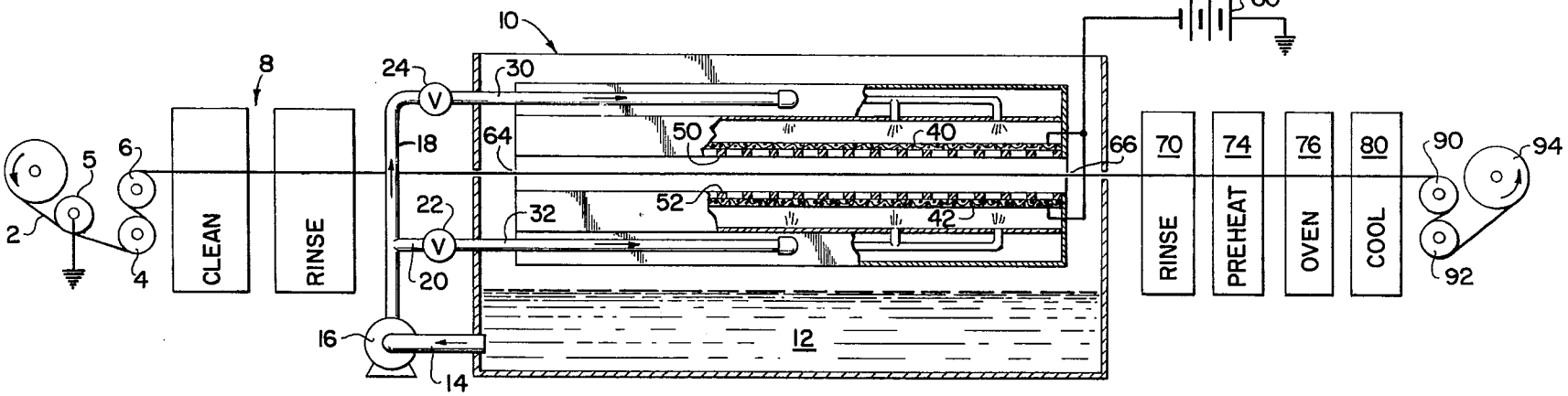
FIG. 1 is a cross sectional drawing figuratively depicting the various stations in the coating system.
Figure 2:
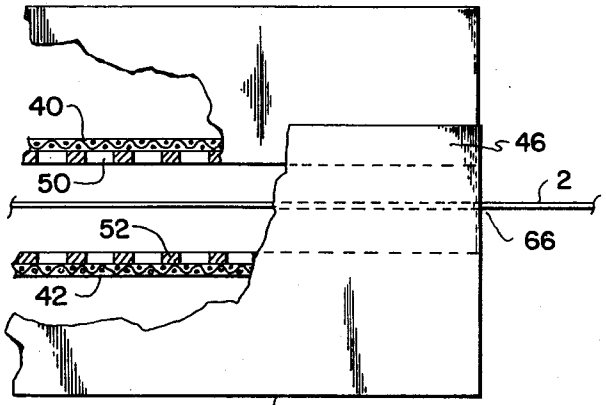
FIG. 2 is a partially cut-away side view of a portion of the coating station.
Figure 3:
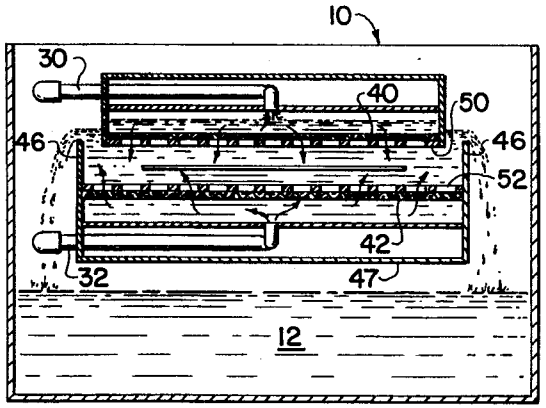
FIG. 3 is an end cross sectional view of the coating station of FIG. 1.

Referring now to FIG. 1, the coating system of the invention is generally shown wherein a coiled metal sheet 2 is unwound and passed through an entry bridle comprising rollers 4 and 6 and then passed through cleaning and rinsing stations generally indicated as 8. Such stages comprise conventional cleaning of the metal surface with a detergent or the like followed by water rinsing. Following the rinsing of the metal, it is passed through coating station 10. Coating station 10 comprises a large tank or reservoir 12 having positioned thereabove nozzle members 30 and 32 between which the uncoiled metal sheet passes. Nozzle members 30 and 32 generally comprise a plurality of spaced apart nozzles which in a preferred embodiment are rectangular in shape with a long axis running in the direction of the metal sheet travel, with the outer surface thereof parallel to the sheet surface. Interposed between nozzle 30 and the upper surface of sheet 2 are respectively sandwiched a metal electrode member 40 which is preferably perforated and a perforated insulating member such as a plastic member or the like 50. Coating material flows from nozzle 30 through electrode 40 and then through the perforated insulator 50 before reaching web 2. A perforated electrode member 42 and insulated member 52 are similarly placed with respect to the lower nozzle 32 beneath sheet 2.

Liquid coating material flows from the reservoir of tank 12 via a pipe 14 to a pump 16. Pump 16 pumps the liquid via pipes 18 and 20, respectively, to the upper nozzle 30 and lower nozzle 32. The amount of liquid or pressure head of the liquid respectively flowing to the nozzles is controlled by valves 22 and 24 which may be used to throttle back one or both of the streams to position the metal sheet therebetween as will be described in more detail below.

In accordance with the invention, coil 2 is maintained at ground potential via a ground roller 5 having copper brush contact points thereon. Electrodes 40 and 42 are maintained at a potential difference, with respect to ground, which may vary from 30 to 1,000 volts, via a power supply which is illustrated in the drawing as a battery 60 but which may comprise a transformer and associated rectifiers when alternating current is used as the source of power. The polarity of electrodes 40 and 42 will vary depending upon the type of coating material used.

Following the coating of the material, the metal web 2 passes through a rinsing station 70, a preheating over 74 to remove moisture prior to baking, a baking oven 76, an a cooling station 80, and then is recoiled after passing through exit bridle rollers 90 and 92 into a coated coil 94.

In accordance with the invention, upstanding weirs 46 are provided along the sides of the coating station adjacent nozzles 32 and extending along the whole length of the coating station. The weirs are joined together by a bottom portion 47 and extend vertically to a point just above the bottom edge of the top electrode 40 to form a trough or channel. This trough creates a flooded condition on the underside of coil 2 by preventing the coating material which passes through nozzle 32 from returning to the reservoir except at the entrance and exit portions 64 and 66 and by flow over the weirs. In this manner, a transient bath is created whereby both surfaces of the web 2 are flooded with coating material thereby providing a uniform deposition of the coating thereon.

In accordance with the invention, the valves 22 and 24 are used to adjust the pressure flow respectively through piping 18 and 20 to nozzles 30 and 32 to control the amount of flow therethrough. By providing a slightly higher volume of flow through valve 22 into nozzles 32, the web 2 s supported by the jetting action of the streams from the nozzles which provide currents of liquid coating impinging against the surfaces of web 2 in a position which, preferably, is midway between electrodes 40 and 42. In this manner, the web is supported throughout the length of the coating station without the necessity for any supporting rollers as in the prior art. Furthermore, the adjustment of valves 22 and 24 provides an accurate positioning of the web so as to be electrically midway between electrodes 40 and 42 to provide equidistant electric fields between the ground potential of web 2 and the potential of the respective electrodes to thereby ensure a uniformity of coating thickness on both sides of the web.

This transient bath, while maintaining both sides of the web in a flooded condition, and providing support for the web through the jetting action of the liquid impinging on the web from the nozzle, provides additional benefits as well.

Rapid electrolyte movement created by the jetting action in the transient bath has been found to remove gas bubbles from the surface of the web or sheet as they are formed during the coating deposition—thus preventing such gas bubbles from interferring with the uniformity or appearance of the coating.

The flowing action of the bath also ensures the removal of depleted bath solution from the surface of the web as the coating material deposits out, thus ensuring a uniform supply of depositable coating material for the web.

The flowing action of the liquid also acts to remove or minimize heat buildup on either the web or the adjacent coating liquid during the deposition.

In one embodiment, the valves 22 and 24 may be adjusted to provide a stronger current or flow of liquid coating against one surface of web 2 to position the web 2 closer to one or the other of electrodes 40 and 42 to provide a thicker coating on the side of the web closer to the respective electrode. In any event, the interposition of the perforated insulators 50 and 52 between the grounded web or sheet and the charged electrodes prevents any inadvertent shorting or electrical contact between web 2 and electrodes 40 and 42.

While the entire coating system has been shown only in diagrammatic form, it should be apparent to those skilled in the art that other stations, for example, for additional rinsing, preheating, cooling and the like, may also be used in connection with the coating system. For example, in addition to the rinse stage shown after the electrocoating, an air knife may be used to remove excess coating material and a preheat oven may be used to remove moisture at lower temperatures preliminary to the higher temperature oven used to bake the coating on the web.

The coatings to be electrically deposited on the web 2 may comprise any dispersible or suspendable material which is capable of migrating under the influence of an electric field toward a charged electrode. While the system has been illustrated using a grounded web with a negative potential, as mentioned previously, the system can be used with the electrodes at a potential more positive with respect to the web, depending upon the type of coating material which is being used. In a preferred embodiment, the coating system is an aqueous system. However, other liquids may be used in place thereof, the coating itself forming no part of the present invention. An example of a coating material which can be used in accordance with this invention is that described and claimed in Rolles et al. U.S. Pat. No. 3,798,143 assigned to the assignee of this invention.

The provision of a straight line of travel through the coating station, and preferably through the drying and baking stations as well, permits omission of rollers for support or redirection of travel through a conventional electrophoretic coating bath, as well as elimination of conventional coating rollers. Elimination of rollers lessens the possibility of damage to the coating prior to baking.

It should be noted, however, that if necessary, supporting rollers can be used to supplement the support given the web by the jetting action of the liquid coating material in the transient bath. Such support, however, is deemed to be only supplemental with the majority of the support, that is, over 50%, derived from the jetting action of the liquid in the transient bath.

It should be further noted that supporting rollers can also be eliminated or minimized in the drying and baking stations as well by using special drying oven configurations which direct air jets against the surfaces of the web to provide support as well as drying or baking action. Such equipment is commercially available such as, for example, the Eyelid floater oven—available from the Ross Engineering Company in New Brunswick, N.J.

To evaluate the system of the invention, a 12-inch wide aluminum strip was run at a line speed of 200 feet per minute through a coating station constructed in accordance with the invention to provide a coating weight of 2.0 to 3.0 milligrams per square inch with an aqueous dispersion of an acrylic resin and using a voltage potential of approximately 150 to 250 volts at a current density of about 20 amps per square foot. The resulting coil was found to have excellent uniformity of coating thereon.

What is claimed is:

1. A continuous system for electrodeposition of coating material on metal sheet stock which comprises:

a. uncoiling and cleaning the sheet;

b. passing the sheet in a substantially straight line through coating, baking and cooling stations; and c. supporting the sheet in said substantially straight position in the coating station by passing the sheet through a transient bath in said coating station in which streams of liquid coating material provide impinging currents respectively on the opposite surfaces of said sheet, said liquid coating material being in electrical communication with at least one charged electrode maintained at a sufficient potential with respect to said metal sheet to promote electrophoretic coating of said sheet by said liquid coating material, and said streams being adjustable to provide positioning and support of said sheet therebetween.

2. The system of claim 1 wherein a perforated insulator is interposed between said metal sheet and said electrically charged electrode.

3. The system of claim 1 wherein said streams are adjusted to space said metal sheet a preselected distance from said electrically charged electrode to control the thickness of coating on one surface of the sheet relative to the opposite surface of said sheet.

4. A system for electrodeposition of coating material on continuous metal sheet stock which comprises:

a. uncoiling and cleaning the sheet;

b. passing the sheet in a substantially straight line through:

1. a transient bath in a coating station;
2. a baking station; and
3. a cooling station;

c. supporting the sheet in said substantially straight position in said transient bath by directing flow of liquid coating material against opposite surfaces of said sheet; and d. coating said sheet with said liquid coating material by electrically contacting said material with at least one charged electrode maintained at a sufficient potential with respect to the sheet to promote deposition of coating material on said sheet.

5. A system according to claim 4 wherein a perforated insulator is interposed between said metal sheet and said electrically charged electrode.

6. The system according to claim 4 wherein said streams are adjusted to space said metal sheet to a preselected distance between a plurality of charged electrodes to control the thickness of coating on one surface of the sheet relative to the opposite surface of said sheet.

7. A system according to claim 4 wherein said sheet is immersed in said transient bath.

8. A system according to claim 7 wherein said sheet is maintained in said immersed condition in said transient bath by passing the sheet through channel means to provide at least a partially restricted liquid flow.

9. A system for electrodeposition of coating material on continuous metal sheet stock which comprises:

a. uncoiling and cleaning the sheet;

b. passing the sheet in a substantially straight line through:

1. a transient bath in a coating station, and said sheet being immersed in said bath by passing said sheet through channel means to provide at least a partially restricted liquid flow in a direction transverse to the movement of said sheet;
2. a baking station; and
3. a cooling station;

c. supporting the sheet in said substantially straight position in said transient bath by directing flow of liquid coating material respectively against upper and lower surfaces of said sheet, said directed flow being adjustable to provide positioning of said sheet therebetween; and d. coating said sheet with said liquid coating material by electrically contacting said material with at least one charged electrode spaced from said sheet having interposed therebetween a perforated insulator, said electrode being maintained at a sufficient potential with respect to the sheet to promote deposition of coating material on said sheet.

10. An apparatus for electrodeposition of coating on continuous sheet, said apparatus comprising:

a. means for uncoiling and cleaning said sheet;

b. means for passing said sheet in a substantially straight line through:

1. a coating station, said station adapted to include a transient bath therein;
2. a baking station; and
3. a cooling station;

c. means for supporting said sheet in said substantially straight position while immersed in said transient bath, said means comprising nozzles adapted for adjustably directing flow of liquid coating material against opposite surfaces of said sheet;

d. means for coating said sheet with said liquid coating material, said coating means comprising at least one charged electrode adapted to be in contact with said liquid coating material and having sufficient potential with respect to said sheet to promote deposition of coating material thereon and further including insulation means interposed between said electrode and said sheet.

* * * * *